US011398184B2

(12) United States Patent
Liu et al.

(10) Patent No.: US 11,398,184 B2
(45) Date of Patent: Jul. 26, 2022

(54) PIXEL DRIVING CIRCUIT, DISPLAY APPARATUS, AND METHOD FOR DRIVING PIXEL DRIVING CIRCUIT

(71) Applicant: BOE TECHNOLOGY GROUP CO., LTD., Beijing (CN)

(72) Inventors: Dongni Liu, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/417,238

(22) PCT Filed: Nov. 3, 2020

(86) PCT No.: PCT/CN2020/126116
§ 371 (c)(1),
(2) Date: Jun. 22, 2021

(87) PCT Pub. No.: WO2021/088792
PCT Pub. Date: May 14, 2021

(65) Prior Publication Data

US 2022/0076616 A1 Mar. 10, 2022

(30) Foreign Application Priority Data

Nov. 5, 2019 (CN) ..... 201911071491.8

(51) Int. Cl.
*G09G 3/32* (2016.01)
*G09G 3/3258* (2016.01)

(52) U.S. Cl.
CPC ..... *G09G 3/32* (2013.01); *G09G 3/3258* (2013.01); *G09G 2300/0842* (2013.01); *G09G 2310/0275* (2013.01); *G09G 2310/061* (2013.01)

(58) Field of Classification Search
CPC ..... G09G 3/32; G09G 2300/0842; G09G 2310/0275; G09G 2310/061; G09G 3/3258
See application file for complete search history.

(56) References Cited

U.S. PATENT DOCUMENTS 10,847,077 B2 * 11/2020 Sakariya ..... G09G 3/2014
10,930,204 B2 * 2/2021 He ..... G09G 3/32
(Continued)

FOREIGN PATENT DOCUMENTS

CN 1698084 A 11/2005
CN 1755778 A 4/2006
(Continued)

OTHER PUBLICATIONS

China Patent Office, First Office Action dated Sep. 2, 2020 for application No. CN201911071491.8.

*Primary Examiner* — Vijay Shankar
(74) *Attorney, Agent, or Firm* — Houtteman Law LLC

(57) ABSTRACT

The present application provides a pixel driving circuit, a display apparatus and a method for driving a pixel driving circuit. The pixel driving circuit includes a driving sub-circuit, a duration control sub-circuit and a data writing sub-circuit. The driving sub-circuit is electrically coupled to the duration control sub-circuit and the data writing sub-circuit, respectively, the data writing sub-circuit is configured to transmit a data signal to the driving sub-circuit, the duration control sub-circuit is configured to control a turned-on duration of the driving sub-circuit, and the driving sub-circuit is configured to control a current of a to-be-driven element according to the data signal during the turned-on duration. The display apparatus includes the pixel driving circuit provided by the present application. The method is applied to the pixel driving circuit provided by the present application.

16 Claims, 7 Drawing Sheets

(56) References Cited

U.S. PATENT DOCUMENTS

| | | | | |
|---|---|---|---|---|
| 11,100,849 | B1 * | 8/2021 | Yang | G09G 3/32 |
| 2014/0218272 | A1 | 8/2014 | Kikuchi et al. | |
| 2018/0182279 | A1 * | 6/2018 | Sakariya | G09G 3/2022 |
| 2019/0251904 | A1 | 8/2019 | Kim et al. | |

FOREIGN PATENT DOCUMENTS

| | | | |
|---|---|---|---|
| CN | 107735832 | A | 2/2018 |
| CN | 108735160 | A | 11/2018 |
| CN | 109872686 | A | 6/2019 |
| CN | 110010057 | A | 7/2019 |
| CN | 110136642 | A | 8/2019 |
| CN | 110782831 | A | 2/2020 |
| KR | 20050043818 | A | 5/2005 |

* cited by examiner

PIXEL DRIVING CIRCUIT, DISPLAY APPARATUS, AND METHOD FOR DRIVING PIXEL DRIVING CIRCUIT

CROSS-REFERENCE TO RELATED APPLICATION

This is a National Phase Application filed under 35 U.S.C. 371 as a national stage of PCT/CN2020/126116, filed on Nov. 3, 2020, an application claiming the benefit to Chinese Patent Application No. 201911071491.8, filed with CNIPA on Nov. 5, 2019, the disclosure of which is incorporated herein by reference in its entirety.

TECHNICAL FIELD

The present disclosure relates to the field of display technology, and in particular, to a pixel driving circuit, a display apparatus, and a method for driving a pixel driving circuit.

BACKGROUND

The micro inorganic light emitting diode has a wide development prospect in the display field because of high brightness and high reliability.

SUMMARY

The present disclosure provides an improved pixel driving circuit, a display apparatus and a method for driving a pixel driving circuit.

The present disclosure provides a pixel driving circuit for providing a signal to a to-be-driven element. The pixel driving circuit includes a driving sub-circuit, a duration control sub-circuit and a data writing sub-circuit. The driving sub-circuit is electrically coupled to the duration control sub-circuit and the data writing sub-circuit, respectively, the data writing sub-circuit is configured to transmit a data signal to the driving sub-circuit, the duration control sub-circuit is configured to control a turned-on duration of the driving sub-circuit, and the driving sub-circuit is configured to control a current of the to-be-driven element according to the data signal during the turned-on duration.

In some embodiments, the duration control sub-circuit includes a comparator coupled to a reference voltage signal line, the driving sub-circuit and a duration signal line, respectively, and the comparator is configured to compare a duration signal input from the duration signal line with a reference voltage signal provided through the reference voltage signal line, and output a comparison signal to control the turned-on duration of the driving sub-circuit.

In some embodiments, a positive input terminal of the comparator is coupled to the duration signal line, a negative input terminal of the comparator is coupled to the reference voltage signal line, and an output terminal of the comparator is coupled to the driving sub-circuit.

In some embodiments, the reference voltage signal is a triangular wave signal, a sawtooth wave signal, or a sine wave signal.

In some embodiments, the duration control sub-circuit further includes a duration control transistor having a gate electrode coupled to an output terminal of the comparator, a first electrode coupled to a duration control signal line through which a duration control signal is provided, and a second electrode coupled to the driving sub-circuit, and the duration control transistor is configured to output the duration control signal according to the comparison signal to control the turned-on duration of the driving sub-circuit.

In some embodiments, the duration control sub-circuit further includes a duration writing sub-circuit having an input terminal coupled to the duration signal line, an output terminal coupled to a first input terminal of the comparator, and a control terminal coupled to a data writing control signal line, and the duration writing sub-circuit is configured to receive a data writing control signal output from the data writing control signal line, and connect the duration signal line with the comparator according to the data writing control signal.

In some embodiments, the duration control sub-circuit further includes a duration storage capacitor having a first end coupled to the first input terminal of the comparator and the output terminal of the duration writing sub-circuit.

In some embodiments, the driving sub-circuit includes a driving transistor having a gate electrode coupled to a second electrode of a duration control transistor of the duration control sub-circuit, a first electrode coupled to the data writing sub-circuit, and a second electrode coupled to the to-be-driven element.

In some embodiments, the data writing sub-circuit includes a data writing transistor having a first electrode electrically coupled to a data line to receive a data signal input from the data line, a second electrode electrically coupled to the driving sub-circuit, and a gate electrode electrically coupled to the data writing control signal line to receive the data writing control signal.

In some embodiments, the pixel driving circuit further includes at least one of: a reset sub-circuit coupled to the driving sub-circuit and the to-be-driven element, respectively, and configured to reset the driving sub-circuit and the to-be-driven element; a compensation sub-circuit coupled to the data writing sub-circuit through the driving sub-circuit and configured to store the data signal input from the data writing sub-circuit; and an operation control sub-circuit coupled to the driving sub-circuit and configured to control the driving sub-circuit to drive the to-be-driven element to emit light.

The present disclosure provides a display apparatus, including a to-be-driven element and the pixel driving circuit as described above, and the pixel driving circuit is coupled with the to-be-driven element.

In some embodiments, the display apparatus includes a plurality of sub-pixels, and each of the plurality of sub-pixels is provided with the pixel driving circuit for driving the to-be-driven element in the sub-pixel to emit light.

In some embodiments, the display apparatus further includes a plurality of duration signal lines configured to transmit duration signals; a plurality of data signal lines configured to transmit the data signal; and a plurality of duration control signal lines configured to transmit duration control signals. Pixel driving circuits corresponding to sub-pixels in a same row are electrically coupled to a same duration control signal line; and pixel driving circuits corresponding to sub-pixels in a same column are electrically coupled to a same duration signal line and a same data signal line.

The present disclosure provides a method for driving a pixel driving circuit applied to the pixel driving circuit as described above, and the method includes: writing a data signal into the driving sub-circuit; writing an operation control signal to control the driving sub-circuit to be turned-on to drive the to-be-driven element to emit light according to the data signal; and controlling a turned-on duration of the driving sub-circuit to control a light emitting duration of the to-be-driven element.

In some embodiments, the controlling the turned-on duration of the driving sub-circuit includes: writing a duration signal; and comparing the duration signal with a reference voltage signal to generate a comparison signal, so as to control the turned-on duration of the driving sub-circuit.

DETAILED DESCRIPTION

Figure 1:
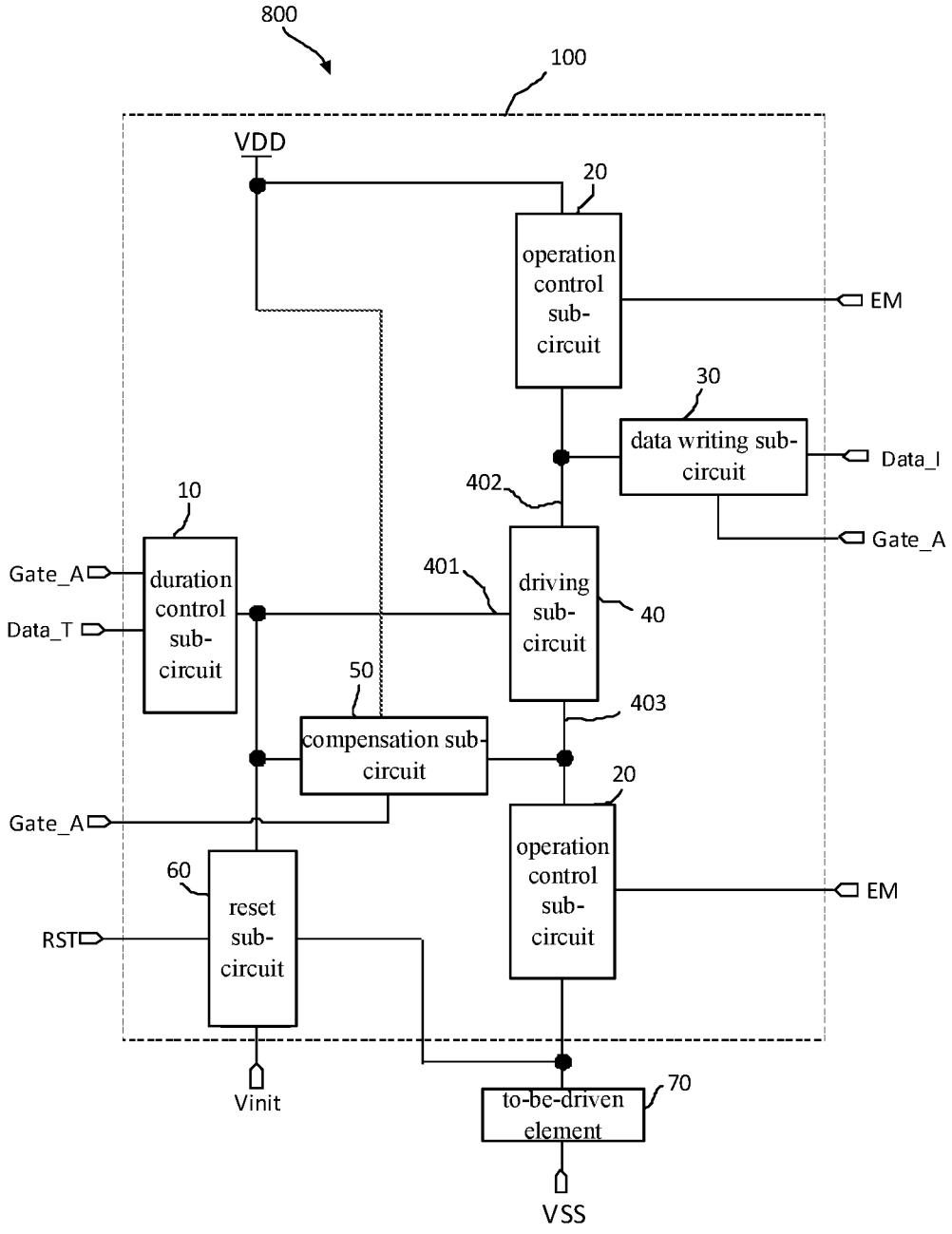
FIG. 1 is a block diagram of a pixel driving circuit according to an embodiment of the present disclosure.

Reference will now be made in detail to the exemplary embodiments, examples of which are illustrated in the accompanying drawings. The following description refers to the accompanying drawings in which the same numbers in different drawings represent the same or similar elements unless otherwise indicated. The implementations described in the following exemplary embodiments do not represent all implementations consistent with the present disclosure. Rather, they are merely examples of devices consistent with certain aspects of the present disclosure, as detailed in the appended claims.

The terminology used herein is for the purpose of describing particular embodiments only and is not intended to limit the present disclosure. Unless otherwise defined, technical or scientific terms used herein shall have the ordinary meaning as understood by one of ordinary skill in the art to which this disclosure belongs. The use of the terms "a" or "an" and "the" and similar words in the specification and the claims of this disclosure do not denote a limitation of quantity, but rather denote the presence of at least one. The term "plurality" means at least two. The word "include" or "comprise" and the like, means that the element or item before "include" or "comprise" include the element(s) or item(s) listed after "include" or "comprise", and the equivalents thereof, and does not exclude additional element(s) or item(s). The terms "connected" or "coupled" and the like are not restricted to physical or mechanical connections, but may include electrical connections, whether direct or indirect. As used in this specification and the appended claims, the singular forms "a", "an", and "the" are intended to include the plural forms as well, unless the context clearly indicates otherwise. It should also be understood that the term "and/or" as used herein refers to and encompasses any and all possible combinations of one or more of the associated listed items.

An image is displayed by driving a to-be-driven element of each pixel in the display apparatus to emit light. The to-be-driven element is a current-driven device, such as a micro light emitting diode (micro LED) or a mini light emitting diode (mini LED) or an organic light emitting diode (OLED). In this case, the operating duration of the to-be-driven element described herein may be understood as the light emitting duration of the light emitting diode.

For inorganic light emitting diodes, such as micro light emitting diodes (micro LEDs) and mini light emitting diodes (mini LEDs), the light emitting efficiency, the brightness of the emitted light, and the chromaticity coordinates of the inorganic light emitting diodes vary with the current density in a case of a low current density, which leads to display quality problems. Since the current with high current density can drive the to-be-driven element to emit stable light, it is considered that the current with high current density is used for driving the to-be-driven element to emit light to display an image, thereby ensuring the light emitting efficiency.

Figure 7:
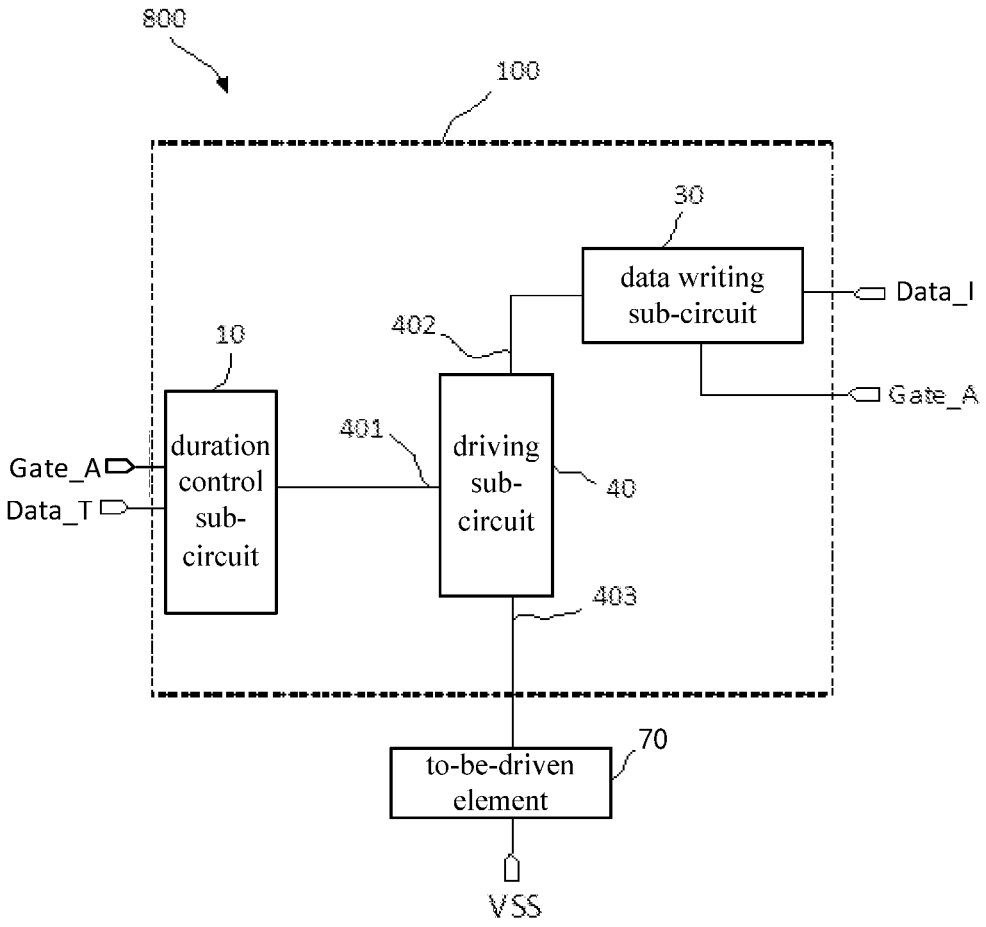
FIG. 7 is a block diagram of a pixel driving circuit according to an embodiment of the present disclosure.

FIG. 1 and FIG. 7 are block diagrams of a pixel driving circuit 100 according to an embodiment of the present disclosure. The pixel driving circuit 100 is disposed in a display apparatus 800, and the display apparatus 800 includes a to-be-driven element 70. The pixel driving circuit 100 is coupled to the to-be-driven element 70, and is configured to drive the to-be-driven element 70 to emit light. The pixel driving circuit 100 includes a driving sub-circuit 40, a duration control sub-circuit 10, and a data writing sub-circuit 30. The driving sub-circuit 40 is electrically coupled to the duration control sub-circuit 10 and the data writing sub-circuit 30, respectively. The data writing sub-circuit 30 is configured to transmit a data signal Data_I. The duration control sub-circuit 10 is configured to control the turned-on duration of the driving sub-circuit 40. The driving sub-circuit 40 is configured to control the current of the to-be-driven element 70 according to the data signal Data_I during the turned-on duration.

The pixel driving circuit 100 may control the magnitude of the current and the light emitting duration of the to-be-driven element 70, may control the current to be larger, so that the stability of the emitted light is high, may control the current alone to realize display of high gray scale images, and may also realize accurate display of low gray scale images under high current by controlling the current and the light emitting duration. The light emitting duration may be controlled according to the magnitude of the current and the gray scale of the image to be displayed, the lower the gray scale of the image is, the shorter the light emitting duration is, and by adjusting the current and the light emitting duration, the emitted light is stable, the gray scale of the image is accurate, and the accuracy of image display is improved.

It will be appreciated that the to-be-driven element 70 includes a light emitting diode. Especially in the case where the to-be-driven element 70 is a micro inorganic LED, the data signal Data_I transmitted by the data writing sub-circuit 30 may be a fixed high-level signal that enables the micro inorganic LED to have a high light emitting efficiency, in which case the pixel driving circuit mainly controls the gray scale through the duration control sub-circuit 10. Alternatively, the potential of the data signal Data_I may be within a voltage range, and the data signal having the potential within the voltage range can ensure that the micro inorganic LED has high light emitting efficiency, and in this case, the pixel driving circuit controls the light emitting brightness of the micro inorganic LED through the data signal Data_I and the duration control sub-circuit 10.

In some embodiments, the pixel driving circuit 100 receives the duration signal Data_T and the data signal Data_I input in time sequence within one frame period, controls the light emitting duration of the to-be-driven element 70 in one frame period according to the duration signal Data_T, and controls the density of the current flowing through the to-be-driven element 70 in the current frame period according to the data signal Data_I. In this manner, independent control of the magnitude of the driving current and the light emitting duration of the to-be-driven element 70 is achieved.

In some embodiments, the duration control sub-circuit 10 of the pixel driving circuit 100 is configured to receive the duration signal Data_T, and the data writing sub-circuit 30 is configured to receive the data signal Data_I. The driving sub-circuit 40 of the pixel driving circuit 100 includes a control terminal 401, a first terminal 402 and a second terminal 403, and the driving sub-circuit 40 is coupled to the data writing sub-circuit 30 through the first terminal 402, coupled to the duration control sub-circuit 10 through the control terminal 401, and coupled to the to-be-driven element 70 through the second terminal 403. The data writing sub-circuit 30 writes the data signal Data_I into the driving sub-circuit 40 through the first terminal 402; the driving sub-circuit 40 generates a driving current according to the data signal Data_I and outputs the current from the second terminal 403 to the to-be-driven element 70; and the duration control sub-circuit 10 controls the turned-on duration of the driving sub-circuit 40 via the control terminal 401.

In some embodiments, the duration control sub-circuit 10 controls the driving sub-circuit 40 to be turned off when the light emitting duration of the to-be-driven element 70 reaches the set time length, so that the to-be-driven element 70 stops emitting light, thereby controlling the light emitting duration of the to-be-driven element 70.

In some embodiments, the pixel driving circuit 100 receives a data writing control signal Gate_A. The data writing control signal Gate_A may control the duration control sub-circuit 10 to be coupled with a duration signal line 31 (see FIG. 2), control the data writing sub-circuit 30 to be couples with a data signal line 32 (see FIG. 2), control the duration control sub-circuit 10 to receive the duration signal Data_T, and control the data writing sub-circuit 30 to receive the data signal Data_I.

It should be noted that although FIG. 7 shows an example in which the second terminal 403 of the driving sub-circuit 40 is directly coupled to the to-be-driven element 70, the present disclosure is not limited thereto. In some embodiments, the driving sub-circuit 40 may be coupled to the to-be-driven element 70 with an intermediate element (e.g., the operation control sub-circuit 20 shown in FIG. 1) therebetween.

In some embodiments, referring to FIG. 1, the pixel driving circuit 100 further includes a reset sub-circuit 60, a compensation sub-circuit 50, the operation control sub-circuit 20, and a power supply terminal VDD. In some embodiments, the reset sub-circuit 60 is coupled to the driving sub-circuit 40 and the to-be-driven element 70, respectively, and configured to reset the driving sub-circuit 40 and the to-be-driven element 70. In some embodiments, the reset sub-circuit 60 is coupled to the control terminal 401 of the driving sub-circuit 40 and a positive voltage terminal of the to-be-driven element 70, respectively. Before displaying an image in each frame period, the reset sub-circuit 60 inputs a reset voltage Vinit to the control terminal 401 of the driving sub-circuit 40 and the to-be-driven element 70 under the control of a reset control signal RST, and resets the voltages at the control terminal 401 of the driving sub-circuit 40 and the to-be-driven element 70, so as to eliminate the influence of the data signal Data_I or the duration signal Data_T left over from the previous frame period on the current frame period.

In some embodiments, the compensation sub-circuit 50 is coupled to the data writing sub-circuit 30 via the driving sub-circuit 40, and configured to store the data signal input by the data writing sub-circuit 30. In some embodiments, the compensation sub-circuit 50 is further configured to store a threshold voltage of the driving sub-circuit 40. In some embodiments, the compensation sub-circuit 50 is coupled between the control terminal 401 and the second terminal 403 of the driving sub-circuit 40, and configured to store the threshold voltage signal of the driving sub-circuit 40 and the data signal Data_I input by the data writing sub-circuit 30 under the control of the data writing control signal Gate_A. In some embodiments, during the light emitting phase of one frame period, the threshold voltage signal compensates the driving sub-circuit 40, so that the driving current output by the driving sub-circuit 40 is only related to the data signal Data_I and is not affected by the threshold voltage of the driving sub-circuit 40 itself, thereby improving the accuracy of the output driving current.

In some embodiments, the operation control sub-circuit 20 is coupled to the driving sub-circuit 40, and configured to control the driving sub-circuit 40 to drive the to-be-driven element 70 to emit light. In some embodiments, the operation control sub-circuit 20 controls the connection/disconnection between the power supply terminal VDD and the driving sub-circuit 40 and the connection/disconnection between the driving sub-circuit 40 and the to-be-driven element 70 under the control of an operation control signal EM, so as to control the time point at which the driving sub-circuit 40 drives the to-be-driven element 70 to emit light.

In some embodiments, the pixel driving circuit 100 receives the duration signal Data_T, the data signal Data_I, the reset voltage Vinit, the data writing control signal Gate_A, and the operation control signal EM, which are described above, in time sequence within one frame period. In some embodiments, the display apparatus 800 includes at least one signal output circuit (not shown) configured to output the duration signal Data_T, the data signal Data_I, the reset voltage Vinit, the data writing control signal Gate_A, and the operation control signal EM in time sequence within one frame period. The pixel driving circuit 100 is coupled to the signal output circuit to receive corresponding signals in time sequence.

Figure 2:
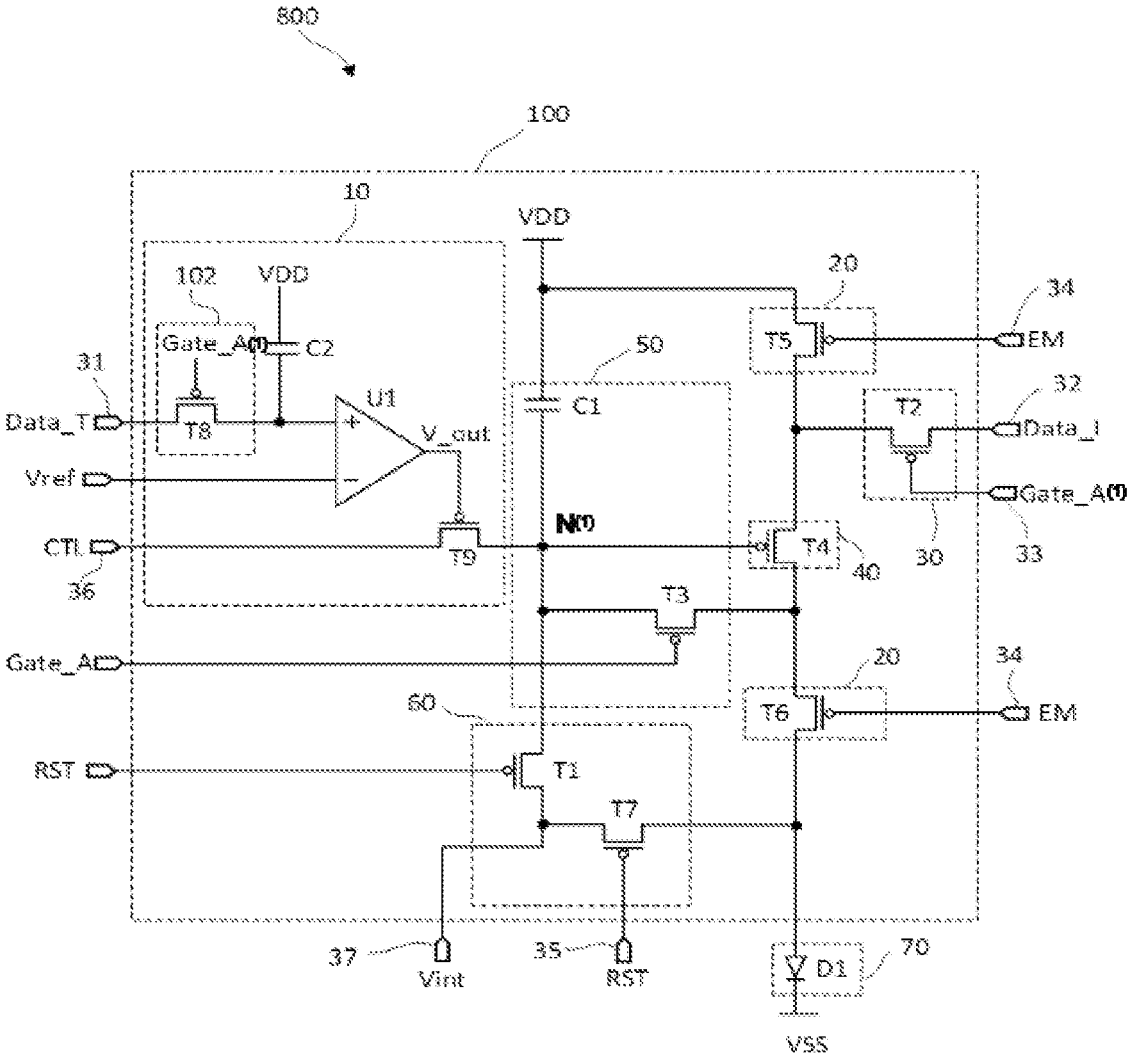
FIG. 2 is a specific circuit schematic diagram of the pixel driving circuit shown in FIG. 1.

FIG. 2 is a specific circuit schematic diagram of the pixel driving circuit 100 shown in FIG. 1. It should be noted that the specific circuit configuration of the duration control sub-circuit 10, the driving sub-circuit 40, and the data writing sub-circuit 30 shown in FIG. 2 may also be applied to the pixel driving circuit 100 shown in FIG. 7.

Referring to FIG. 2, the to-be-driven element 70 may include a micro light emitting diode D1; the duration control sub-circuit 10 includes a comparator U1, which is coupled to the driving sub-circuit 40 and the duration signal line 31, and configured to compare the duration signal Data_T input from the duration signal line 31 with a reference voltage signal Vref, and output a comparison signal V_out to control the turned-on duration of the driving sub-circuit 40. The comparator U1 compares the duration signal Data_T with the reference voltage signal Vref to generate a comparison signal V_out, and the circuit configuration thereof is simple.

In some embodiments, the duration control sub-circuit 10 includes a duration writing sub-circuit 102 coupled between the duration signal line 31 and the comparator U1, and the duration writing sub-circuit 102 is coupled to a data writing control signal line 33. The duration writing sub-circuit 102 is configured to receive the data writing control signal Gate_A output by the data writing control signal line 33, and couple the duration signal line 31 with the comparator U1 according to the data writing control signal Gate_A. The duration writing sub-circuit 102 controls the connection/disconnection between the duration signal line 31 and the comparator U1, and the duration signal line 31 and the comparator U1 are disconnected after the comparator U1 receives the duration signal Data_T input through the duration signal line 31, so that when the current frame period is not finished, the image display in the current frame period is prevented from being influenced by the duration signal Data_T of the next frame input through the duration signal line 31.

In some embodiments, the duration writing sub-circuit 102 includes a duration writing transistor T8 having a gate electrode coupled to the data writing control signal line 33, a first electrode coupled to the duration signal line 31, and a second electrode coupled to the comparator U1. The duration writing transistor T8 is turned on by the data writing control signal Gate_A, thereby coupling the duration signal line 31 with the comparator U1.

In some embodiments, the duration control sub-circuit 10 includes a duration storage capacitor C2 coupled between the comparator U1 and the duration writing sub-circuit 102, and configured to store the duration signal Data_T, so that when the duration writing sub-circuit 102 is turned off, the duration storage capacitor C2 can provide the duration signal Data_T for the comparator U1 to compare the duration signal Data_T with the reference voltage signal Vref and generate the comparison signal V_out. In some embodiments, the reference voltage signal Vref is a time varying voltage signal. In some embodiments, the reference voltage signal Vref is a triangular wave signal, a sawtooth wave signal, or a sine wave signal. In the present embodiment, the reference voltage signal Vref is a triangular wave signal. When the reference voltage signal Vref is greater than the duration signal Data_T, the comparison signal V_out output by the comparator U1 includes a low level; when the reference voltage signal Vref is smaller than the duration signal Data_T, the comparison signal V_out output by the comparator U1 includes a high level. The duty ratio of the comparison signal V_out output by the comparator U1 in each frame period can be controlled by the magnitude of the duration signal Data_T.

Figure 3:
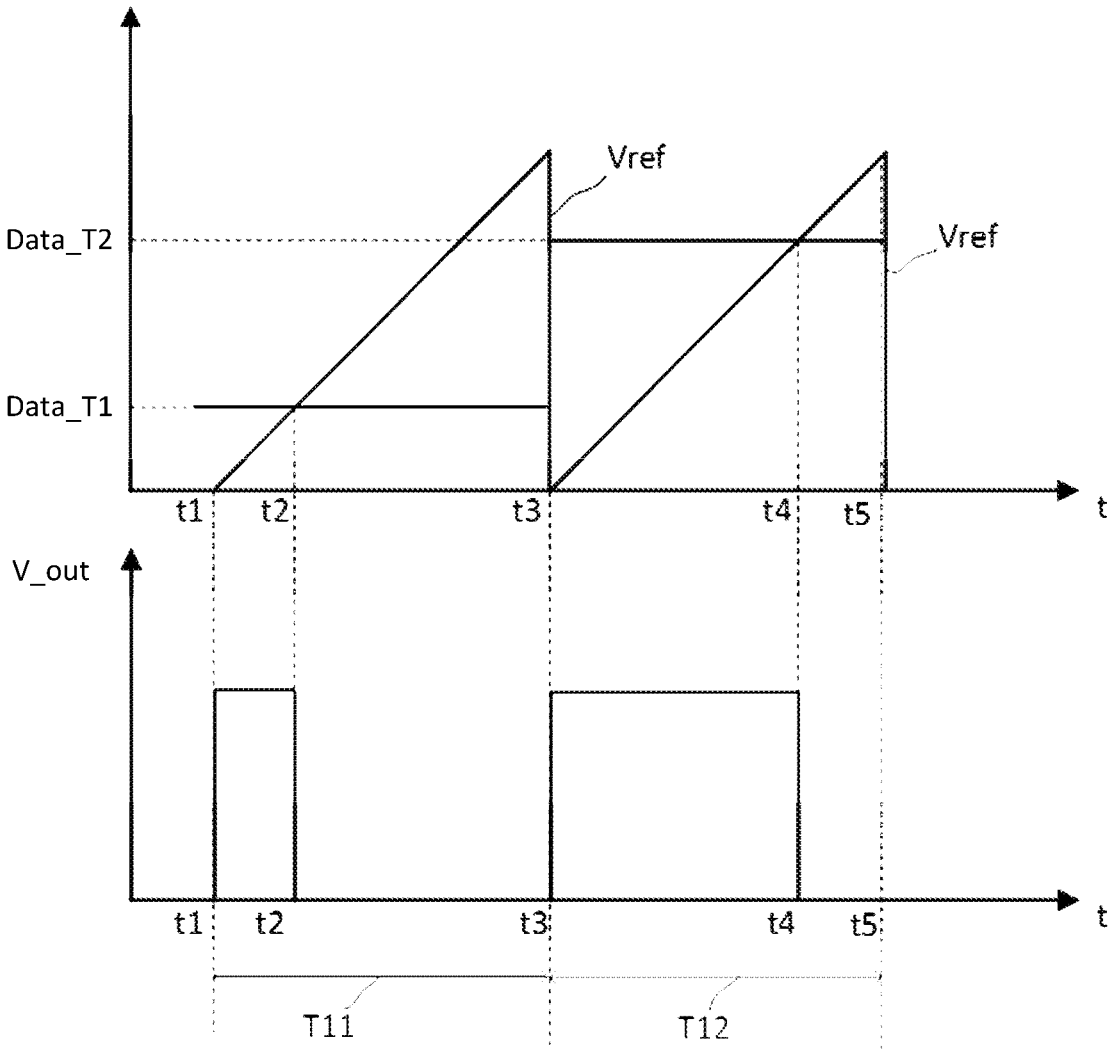
FIG. 3 is a waveform diagram of input and output of a comparator during two frame periods in an embodiment of the present disclosure.

FIG. 3 is a waveform diagram of input and output of the comparator U1 during two frame periods according to an embodiment of the present disclosure. According to FIG. 3, the magnitude of the duration signal Data_T is Data T1 in the frame period T11, the reference voltage signal Vref is greater than Data T1 and the comparator U1 outputs a low level in the time period t2-t3; and the magnitude of the duration signal Data_T is Data T2 in the frame period T12, the reference voltage signal Vref is greater than Data T1 and the comparator U1 outputs a low level in the time period t4-t5. Due to the different magnitudes of Data T1 and Data T2, the duty ratios of the output comparison signal V_out in the frame periods T11 and T12 are different.

Figure 4:
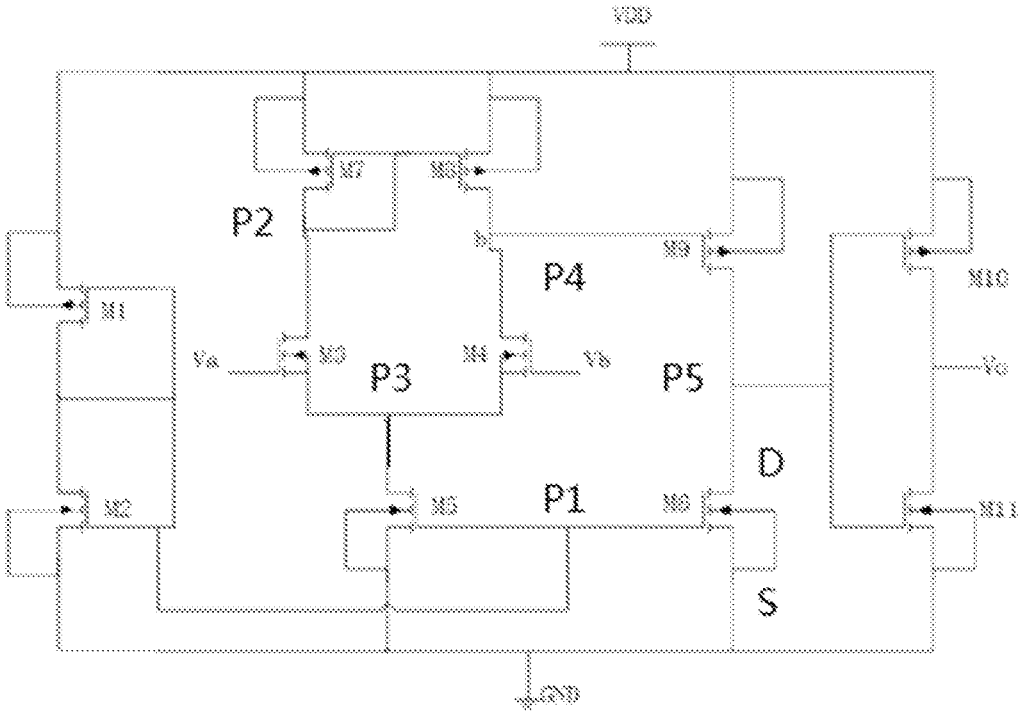
FIG. 4 is a specific circuit schematic diagram of the comparator shown in FIG. 2.

FIG. 4 is a specific circuit schematic diagram of the comparator U1 shown in FIG. 2. In FIG. 4, Va denotes a positive input terminal of the comparator U1, Vb denotes a negative input terminal of the comparator U1, and Vo denotes an output terminal of the comparator U1. A high-level voltage is output from Vo when the voltage input at Va is higher than the voltage input at Vb, and a low-level voltage is output from Vo when the voltage input at Va is lower than the voltage input at Vb.

Referring to FIG. 2 again, in some embodiments, the positive input terminal of the comparator U1 is coupled to the duration signal line 31 and configured to receive duration signal Data_T, the negative input terminal of the comparator U1 is configured to receive the reference voltage signal Vref, and the output terminal of comparator U1 is coupled to the driving sub-circuit 40. The comparator U1 outputs a comparison signal V_out with a corresponding duty ratio according to the duration signal Data_T in each frame period, and controls the turned-on duration of the driving sub-circuit 40 through the comparison signal V_out.

In some embodiments, the duration control sub-circuit 10 includes a duration control transistor T9 coupled to the comparator U1 and the driving sub-circuit 40, respectively, and the duration control transistor T9 is configured to output a duration control signal CTL according to the comparison signal V_out to control the turned-on duration of the driving sub-circuit 40. In some embodiments, a gate electrode of the duration control transistor T9 is coupled to the output terminal of the comparator U1, a first electrode of the duration control transistor T9 is coupled to a duration control signal line 36, and a second electrode of duration control transistor T9 is coupled to the driving sub-circuit 40. When the duration control transistor T9 is turned on under the control of the comparison signal V_out, the duration control signal CTL is output to control the turned-on duration of the driving sub-circuit 40. In some embodiments, when the comparison signal V_out is at a low level, the duration control transistor T9 is turned on.

In some embodiments, the duration control signal CTL controls the driving sub-circuit 40 to be turned off, so that the to-be-driven element 70 stops emitting light, thereby controlling the light emitting duration of the to-be-driven element 70 in one frame period. In some embodiments, the driving sub-circuit 40 includes a driving transistor T4 having a gate electrode coupled to the second electrode of the duration control transistor T9 of the duration control sub-circuit 10, a first electrode coupled to the data writing sub-circuit 30, and a second electrode coupled to the to-be-driven element 70. The driving transistor T4 receives the data signal Data_I input from the data writing sub-circuit 30 through its first electrode, generates a corresponding driving current according to the data signal Data_I, and inputs the driving current to the to-be-driven element 70 through its second electrode. In some embodiments, the duration control signal CTL controls the driving transistor T4 to be turned off through the gate electrode of the driving transistor T4, so that the first electrode and the second electrode of the driving transistor T4 are disconnected, and the to-be-driven element 70 stops emitting light.

In some embodiments, the data writing sub-circuit 30 includes a data writing transistor T2 having a first electrode electrically coupled to the data line 32 to receive the data signal Data_I input from the data line 32, a second electrode electrically coupled to the driving sub-circuit 40, and a gate electrode electrically coupled to the data writing control signal line 33 to receive the data writing control signal Gate_A. In some embodiments, the data writing control signal Gate_A controls the data writing transistor T2 to be turned on, the data writing transistor T2 writes the data signal Data_I to the driving transistor T4, and the driving transistor T4 generates a driving current with a corresponding magnitude according to the data signal Data_I. In different frame periods, the data signal Data_I has different magnitudes, and thus the driving current received by the to-be-driven element 70 has different magnitudes. Therefore, it is achieved for the pixel driving circuit 100 in one frame period that the light emitting duration of the to-be-driven element 70 and the driving current are controllable, and it can realize low gray scale display of images and improve the accuracy of image display by controlling the light emitting duration and the driving current.

In the present embodiment, the reset sub-circuit 60 includes a first reset transistor T1 and a second reset transistor T7, gate electrodes of the first reset transistor T1 and the second reset transistor T7 are respectively coupled to a reset control line 35, and first electrodes of the first reset transistor T1 and the second reset transistor T7 are respectively coupled to a reset signal terminal 37, which generates a reset voltage Vint. A second electrode of the first reset transistor T1 is coupled to the gate electrode of the driving transistor T4, and a second electrode of the second reset transistor T2 is coupled to the positive voltage terminal of the to-be-driven element 70. The first reset transistor T1 and the second reset transistor T7 are turned on by a reset control signal RST input from the reset control line 35, and thus the reset voltage Vint generated by the reset signal terminal 37 is applied to the gate electrode of the driving transistor T4 and the positive voltage terminal of the to-be-driven element 70, so that the gate electrode of the driving transistor T4 and the positive voltage terminal of the to-be-driven element 70 are reset, so as to eliminate the influence of the data signal Data_I left over from the previous frame period on the current frame.

In the present embodiment, the compensation sub-circuit 50 includes a compensation transistor T3 and a data signal storage capacitor C1, a gate electrode of the compensation transistor T3 is coupled to the data writing control signal line 33, a first electrode thereof is coupled to the gate electrode of the driving transistor T4, and a second electrode thereof is coupled to the second electrode of the driving transistor T4. The data writing control signal Gate_A controls the compensation transistor T3 to be turned on to write the data signal Data_I, which is written by the data writing transistor T2 into the first electrode of the driving transistor T4, into the gate electrode of the driving transistor T4 through the compensation transistor T3. The data signal storage capacitor C1 is coupled to the gate electrode of the driving transistor T4 and the first electrode of the compensation transistor T3, and stores the data signal Data_I written into the gate electrode of the driving transistor T4, so that when the compensation transistor T3 is turned off, the data signal storage capacitor C1 can supply the data signal Data_I, and the driving transistor T4 can generate a driving current according to the data signal Data_I. Meanwhile, a fixed voltage drop exists when the data signal Data_I is transmitted through the first electrode and the second electrode of the driving transistor T4, and when a specific circuit is designed, the compensating transistor T3 and the driving transistor T4 may be selected as transistors with the same structure, so that the compensating transistor T3 compensates the portion of the data signal Data_I, which is lost on the driving transistor T4, and the accuracy of image display is ensured.

In the present embodiment, the pixel driving circuit 100 includes the power supply terminal VDD. The operation control sub-circuit 20 includes a first emission control transistor T5 and a second emission control transistor T6. Gate electrodes of the first emission control transistor T5 and the second emission control transistor T6 are coupled to an operation control signal line 34. A first electrode of the first emission control transistor T5 is coupled to the power supply terminal VDD, and a second electrode of the first emission control transistor T5 is coupled to the driving transistor T4. A first electrode of the second emission control transistor T6 is coupled to the to-be-driven element 70, and a second electrode of the second emission control transistor T6 is coupled to the driving transistor T4. The first emission control transistor T5 controls the connection/disconnection between the power supply terminal VDD and the driving transistor T4, and the second emission control transistor T6 controls the connection/disconnection between the driving transistor T4 and the to-be-driven element 70. In one frame period, when an image display phase is started, that is, when the light emitting phase of the to-be-driven element 70 is started, the operation control signal EM controls the first emission control transistor T5 and the second emission control transistor T6 to be turned on, so that a current path is formed from the power supply terminal VDD to the driving transistor T4 and to the to-be-driven element 70, and the to-be-driven element 70 emits light. In other embodiments, the first emission control transistors T5 and the second emission control transistor T6 are controlled to be turned on by different control signals. In the light emitting phase of one frame period of the present disclosure, since the data signal Data_I, which is generally a voltage signal, generated according to the gray scale of the image has been written into the gate electrode of the driving transistor T4, the voltage of the power supply terminal VDD is applied to the first electrode of the driving transistor T4 when the power supply terminal VDD, the driving transistor T4 and the to-be-driven element 70 are electrically coupled, and a voltage difference is formed between the first electrode and the gate electrode of the driving transistor T4. The magnitude of the driving current can be controlled according to the voltage difference, so that the to-be-driven element 70 emits light according to the gray scale of the image to be displayed. The to-be-driven element 70 in the present embodiment may include a micro light emitting diode D1.

In some embodiments of the present disclosure, the transistors in the pixel driving circuit 100 include N-type transistors, and in some other embodiments, the transistors in the pixel driving circuit 100 include P-type transistors. For convenience of description, the transistors other than the constituent elements of the comparator U1 referred to in the present disclosure are P-type transistors.

It is to be noted that, although in the above examples, the to-be-driven element 70 is described as a light emitting element, and the driving sub-circuit 70 is described as driving the to-be-driven element 70 to emit light, the present disclosure is not limited thereto. The to-be-driven element 70 may be another type of element as long as it needs to be driven and the driving duration thereof needs to be changed under control.

Figure 5:
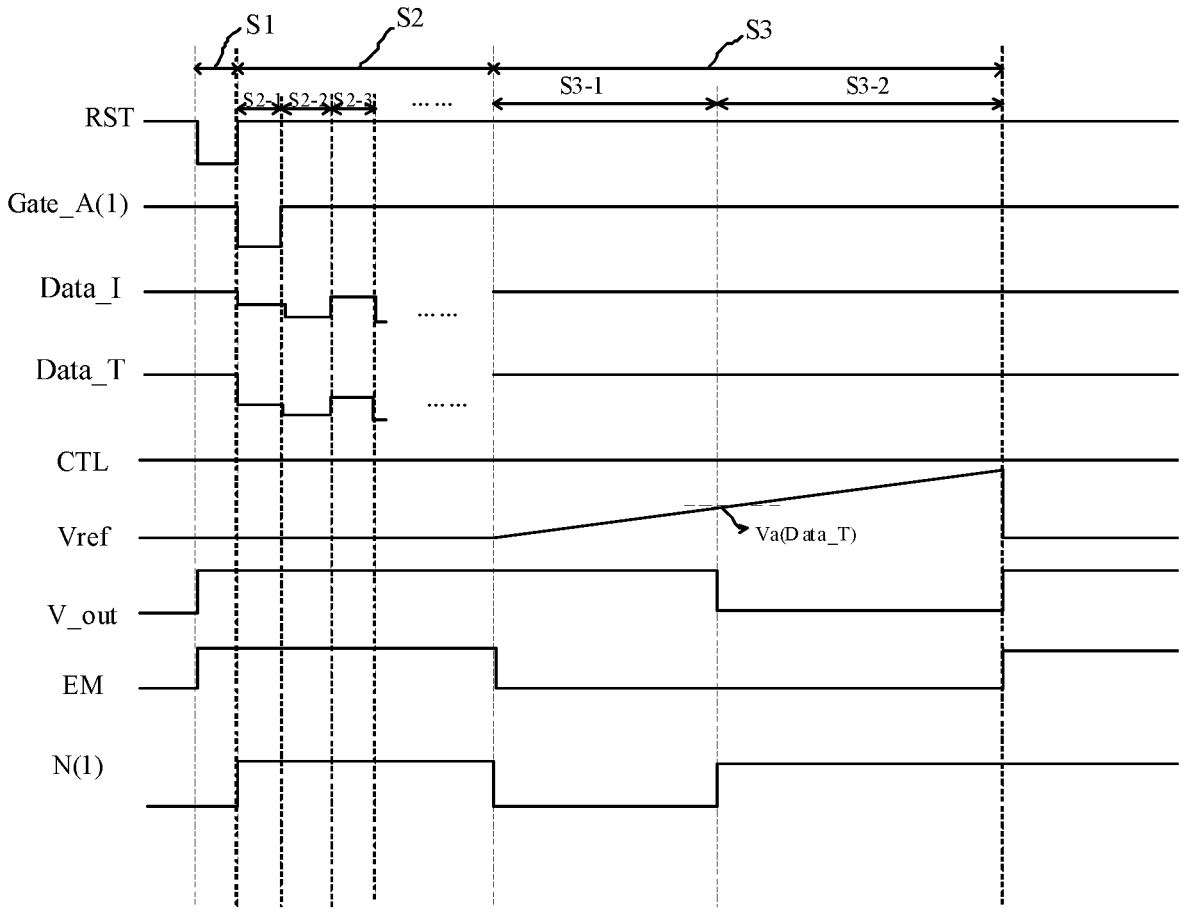
FIG. 5 is a timing diagram of the pixel driving circuit shown in FIG. 2.

FIG. 5 is a timing diagram of the pixel driving circuit 100 shown in FIG. 2, and illustrates the timing diagram of signals of the pixel driving circuit 100 in one frame period. According to FIG. 5, the operation the pixel driving circuit 100 in one frame period includes a reset phase S1, a data writing phase S2-1, and an operation control phase S3.

In the reset phase S1, the first reset transistor T1 and the second reset transistor T7 are turned on by a low-level reset control signal RST output from the reset control line 35, and at the same time, the first emission control transistor T5 and the second emission control transistor T6 are turned off by a high-level duration control signal CTL output from the operation control signal line 34, the compensation transistor T3 is turned off by a high level output from the control signal line Gate_A(1), the duration writing transistor T8 and the data writing transistor T2 are turned off by a high level output from the data writing control signal line 33, the comparison signal V_out output from the comparator U1 is at a high level, the duration control transistor T9 is turned off, and the reset voltage Vint output from the reset signal terminal 37 is applied to the gate electrode of the driving transistor T4 and an anode of the micro light emitting diode D1, in which the reset voltage Vint may be a low-level voltage, such as a ground voltage. In the reset phase S1, the data signal storage capacitor C1 and the anode of the micro light emitting diode D1 are discharged through the first reset transistor T1 and the second reset transistor T7, respectively, and the voltage at the gate electrode of the driving transistor T4 and the voltage at the anode of the micro light emitting diode D1 are the reset voltage Vint, so that the data signal Data_I left over from the previous frame period at the gate electrode of the driving transistor T4 and the anode of the micro light emitting diode D1 is cleared, thereby improving the display accuracy of the current frame period.

It can be understood that for an array substrate or a display panel including a plurality of pixel driving circuits arranged in an array, all the pixel driving circuits may perform the reset phase S1 at the same time.

In the data writing phase S2-1, the first reset transistor T1 and the second reset transistor T7 are turned off by the high-level reset control signal RST output from the reset control line 35, and the reset voltage Vint is stored in the data signal storage capacitor C1. The data writing transistor T2, the duration writing transistor T8, and the compensation transistor T3 are turned on by a low level output from the control signal line Gate_A, and the first emission control transistor T5 and the second emission control transistor T6 are turned off by the high-level operation control signal EM output from the operation control signal line 34. The data signal Data_I is written into the first electrode of the driving transistor T4 through the data writing transistor T2, and the driving transistor T4 is turned on by its own characteristics, for example, the driving transistor T4 is turned on when the potential at the gate electrode thereof is lower than the potential at the first electrode thereof. The data signal Data_I charges the data signal storage capacitor C1 through the driving transistor T4 and the compensating transistor T3, the voltage at the gate electrode of the driving transistor T4 increases, the voltage at the first electrode of the driving transistor T4 is maintained at Vdata, and when the voltage at the gate electrode of the driving transistor T4 is Vdata+Vth, the driving transistor T4 is turned off. Here, Vdata denotes a voltage of the data signal Data_I, and Vth denotes a threshold voltage of the driving transistor T4. Meanwhile, the duration signal Data_T is stored to the duration storage capacitor C2 through the duration writing transistor T8. In some embodiments, the voltage of the duration signal Data_T in different frame periods is different in magnitude. At this phase, the reference voltage signal Vref is smaller than the duration signal Data_T, the comparison signal V_out output by the comparator U1 is at a high level, and the duration control transistor T9 is turned off.

It can be understood that for an array substrate or a display panel including a plurality of pixel driving circuits arranged in an array, the pixel driving circuits in the same row are coupled with the same control signal line Gate_A, while the pixel driving circuits in different rows are coupled with different control signal lines Gate_A, and the control signal lines Gate_A coupled with the pixel driving circuits in adjacent rows are coupled in a cascade manner; and the whole array substrate or display panel is written in a progressive scan mode. For the whole array substrate or display panel, one data writing phase S2 is included in one frame period, and one data writing phase S2 includes a plurality of data writing sub-phases S2-1, S2-2, S2-3, etc.

In the operation control phase S3, an effective operation control signal EM is written to turn on the first emission control transistor T5 and the second emission control transistor T6. The operation control phase S3 may further include a light-emitting sub-phase S3-1 and a stop-light-emitting sub-phase S3-2.

In the light-emitting sub-phase S3-1, the first reset transistor T1 and the second reset transistor T7 are turned off by a high level output from the reset control line 35, the data writing transistor T2, the duration writing transistor T8 and the compensation transistor T3 are turned off by a high level output from the control signal line Gate_A(1), the reference voltage signal Vref is smaller than the duration signal Data_T, the comparison signal V_out output from the comparator U1 is at a high level, the duration control transistor T9 is turned off, the first emission control transistor T5 and the second emission control transistor T6 are turned on by a low level output from the operation control signal line 34, the data signal Data_I (at a low level potential) stored at one end (i.e., the node N(1)) of the data signal storage capacitor C1 and the voltage applied from the power supply terminal VDD form a voltage difference, the driving transistor T4 generates a driving current for driving the micro light emitting diode D1 to emit light in the current frame period according to the voltage difference, and transmits the driving current to the micro light emitting diode D1 through the second emission control transistor T6, and the micro light emitting diode D1 emits light.

In the stop-light-emitting sub-phase S3-2, the first reset transistor T1 and the second reset transistor T7 are turned off by a high level output from the reset control line 35, the data writing transistor T2, the duration writing transistor T8 and the compensation transistor T3 are turned off by a high level output from the control signal line Gate_A(1), the reference voltage signal Vref is greater than the duration signal Data_T (which may be Va (Data_T) in FIG. 5, the values of Va may be the same or different for different pixel circuits), the comparison signal V_out output by the comparator U1 is at a low level, the duration control transistor T9 is turned on, the duration control transistor T9 outputs a duration control signal CTL (at a high level potential) to the gate electrode of the driving transistor T4, so that the potential at the node N(1) becomes high, the driving transistor T4 is turned off, and the micro light emitting diode D1 stops emitting light.

It can be understood that for an array substrate or a display panel including a plurality of pixel driving circuits arranged in an array, all the pixel driving circuits can be simultaneously written with effective operation control signals to realize the display of gray-scale pictures. This is because each pixel driving circuit is written with a different Data_T signal in the data writing sub-phase, and therefore, each pixel driving circuit can control the micro light emitting diode D1 to emit light for different periods of time in the operation control phase.

In some embodiments, the data writing phase and the operation control phase may also be performed sequentially row by row, that is, the first row of pixel driving circuits complete the data writing phase and the operation control phase first, and then the second row of pixel driving circuits enter the data writing phase and the operation control phase, and so on, until the n-th row of pixel driving circuits enter the operation control phase. The effective durations of the operation control signals EM corresponding to the pixel driving circuits in each row in the operation phase are the same. In some other embodiments, the data writing phase and the operation control phase may also be separately and sequentially performed row by row, that is, the first row of pixel driving circuits complete the data writing phase first, and then the second row of pixel driving circuits enter the data writing phase, and so on, until the n-th row of pixel driving circuits complete the data writing phase; and then, the first row of pixel driving circuits complete the operation control phase, and then the second row of pixel driving circuits enter the operation control phase, and so on, until the n-th row of pixel driving circuits complete the operation control phase.

The pixel driving circuit 100 of the present disclosure respectively controls the driving current and the light emitting duration of the to-be-driven element 70, so as to realize display of low gray scale images, thereby improving the accuracy of the image display.

Figure 6:
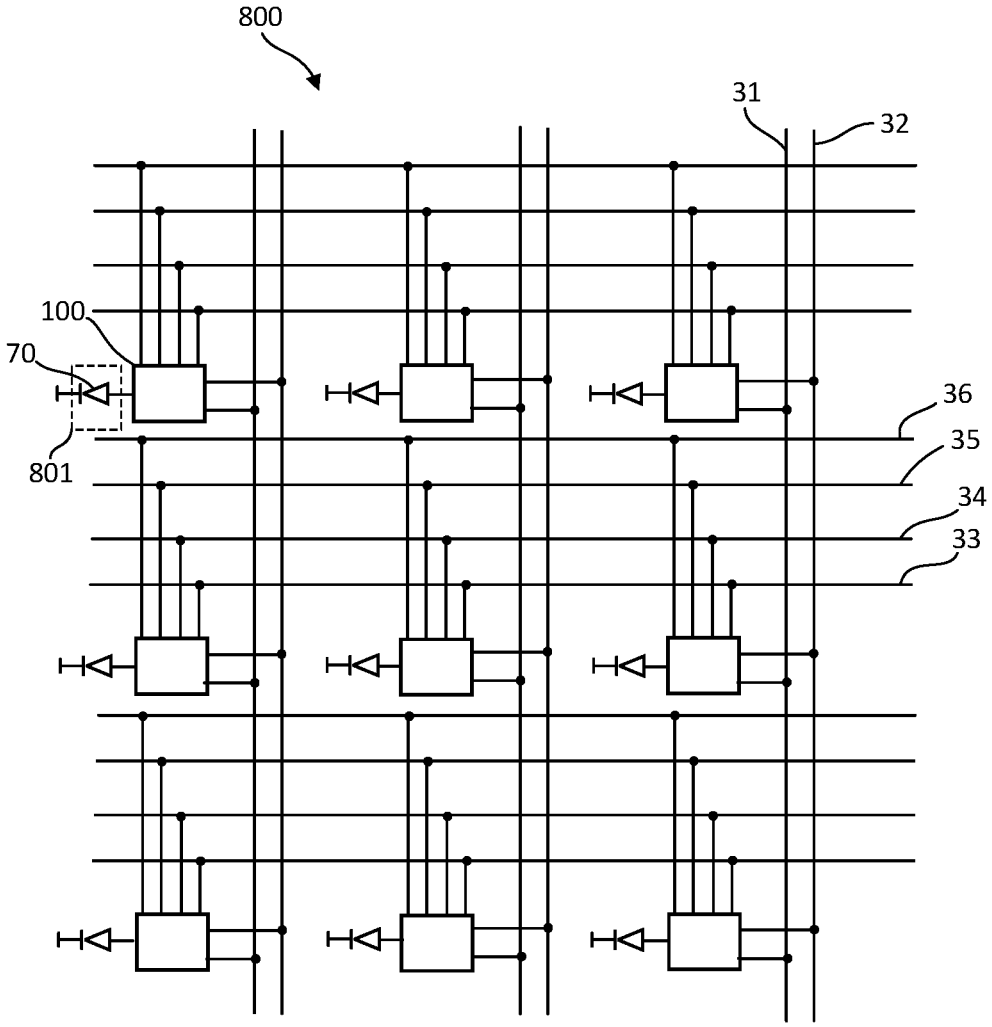
FIG. 6 is a pixel matrix diagram of an embodiment of a display apparatus according to the present disclosure.

FIG. 6 is a pixel matrix diagram of an embodiment of a display apparatus 800 according to the present disclosure. The display apparatus 800 provided by the present disclosure includes a to-be-driven element 70 and a pixel driving circuit 100 as described above. In some embodiments, the display apparatus 800 includes a plurality of sub-pixels 801, and each sub-pixel 801 is disposed therein with a respective pixel driving circuit 100 for driving the to-be-driven element 70 of the sub-pixel 801 to emit light. The to-be-driven element 70 includes a micro light emitting diode (micro LED) or a mini light emitting diode (mini LED) or an organic light emitting diode (OLED). In some embodiments, the display apparatus 800 includes a plurality of duration signal lines 31, a plurality of data signal lines 32, and a plurality of duration control signal lines 36. The duration signal line 31 is configured to transmit a duration signal Data_T; the data signal line 32 is configured to transmit a data signal Data_I; and the duration control signal line 36 is configured to transmit a duration control signal CTL. The pixel driving circuits 100 corresponding to the sub-pixels 801 in the same row are electrically coupled to the same duration control signal line 36; and the pixel driving circuits 100 corresponding to the sub-pixels 801 in the same column are electrically coupled to the same duration signal line 31 and the same data signal line 32.

In some embodiments, the display apparatus 800 further includes a plurality of data writing control signal lines 33, a plurality of operation control signal lines 34, and a plurality of reset control lines 35. The data writing control signal line 33 is configured to transmit a writing control signal Gate_A, the operation control signal line 34 is configured to transmit an operation control signal EM, and the reset control line 35 is configured to transmit a reset control signal RST. The pixel driving circuits 100 corresponding to the sub-pixels 801 in the same row are electrically coupled to the same data writing control signal line 33, the same reset control line 35, and the same operation control signal line 34. In the process of displaying images by the display apparatus 800, control signals are sent to each row of pixel driving circuits 100 through a corresponding control line according to the time sequence, so as to control the pixel driving circuits 100; and data signals are sent to each column of pixel driving circuits 100 through a corresponding data line according to the time sequence, so as to control the image display.

In some embodiments, the display apparatus 800 may further include other components, such as a signal decoding circuit, a voltage conversion circuit, etc., which may be conventional components and will not be described in detail herein. In some embodiments, the display apparatus 800 of the present disclosure may be applied to any product or component with a display function, such as an electronic paper, a mobile phone, a tablet computer, a television, a display, a notebook computer, a digital photo frame, or a navigator. For technical effects of the display apparatus 800, reference may be made to technical effects of the pixel driving circuit 100 provided in the embodiments of the present disclosure, details of which are not repeated here.

The present disclosure further provides a method for driving a pixel driving circuit, and the method is used for driving the pixel driving circuit 100 provided by the present disclosure.

The method includes steps S1-S2.

In step S1, a data signal is written into the driving sub-circuit.

In step S2, an operation control signal is written to control the driving sub-circuit to be turned on to drive the to-be-driven element to emit light according to the data signal; and meanwhile, the turned-on duration of the driving sub-circuit is controlled to control the light emitting duration of the to-be-driven element.

In some embodiments, the step S2 of controlling the turned-on duration of the driving sub-circuit includes sub-steps S21 and S22.

In sub-step S21, a duration signal is written.

In sub-step S22, the duration signal is compared with the reference voltage signal to generate a comparison signal for controlling the turned-on duration of the driving sub-circuit.

The method for driving the pixel driving circuit provided by the present disclosure can independently control the driving current and the light emitting duration of the to-be-driven element 70 driven by the pixel driving circuit 100, which realize the display of the low gray scale image by controlling the light emitting duration, and improve the display accuracy.

For the method embodiment, since it substantially corresponds to the device embodiment, reference may be made to the partial description of the device embodiment for relevant points. The method embodiment and the device embodiment are complementary.

The above description is only an exemplary embodiment of the present disclosure and should not be taken as limiting the present disclosure, and any modifications, equivalents, improvements and the like made within the spirit and principle of the present disclosure should be encompassed in the protection scope of the present disclosure.

What is claimed is:

1. A pixel driving circuit for providing a signal to a to-be-driven element, the pixel driving circuit comprising: a driving sub-circuit, a duration control sub-circuit and a data writing sub-circuit, wherein the driving sub-circuit is electrically coupled to the duration control sub-circuit and the data writing sub-circuit, respectively, the data writing sub-circuit is configured to transmit a data signal to the driving sub-circuit, the duration control sub-circuit is configured to control a turned-on duration of the driving sub-circuit, and the driving sub-circuit is configured to control a current of the to-be-driven element according to the data signal during the turned-on duration, wherein the duration control sub-circuit comprises a comparator coupled to a reference voltage signal line, the driving sub-circuit and a duration signal line, and the comparator is configured to compare a duration signal input from the duration signal line with a reference voltage signal provided through the reference voltage signal line, and output a comparison signal to control the turned-on duration of the driving sub-circuit, and wherein the duration control sub-circuit further comprises a duration writing sub-circuit having an input terminal coupled to the duration signal line, an output terminal coupled to a first input terminal of the comparator, and a control terminal coupled to a data writing control signal line, and the duration writing sub-circuit is configured to receive a data writing control signal output from the data writing control signal line, and connect the duration signal line with the comparator according to the data writing control signal.

2. The pixel driving circuit of claim 1, wherein the reference voltage signal is a triangular wave signal, a sawtooth wave signal, or a sine wave signal.

3. A display apparatus, comprising a to-be-driven element and the pixel driving circuit of claim 2, wherein the pixel driving circuit is coupled with the to-be-driven element, and the to-be-driven element is a current-driven light emitting diode.

4. The pixel driving circuit of claim 1, wherein the duration control sub-circuit further comprises a duration control transistor having a gate electrode coupled to an output terminal of the comparator, a first electrode coupled to a duration control signal line through which a duration control signal is provided, and a second electrode coupled to the driving sub-circuit, and the duration control transistor is configured to output the duration control signal according to the comparison signal to control the turned-on duration of the driving sub-circuit.

5. A display apparatus, comprising a to-be-driven element and the pixel driving circuit of claim 4, wherein the pixel driving circuit is coupled with the to-be-driven element, and the to-be-driven element is a current-driven light emitting diode.

6. The pixel driving circuit of claim 1, wherein the duration control sub-circuit further comprises a duration storage capacitor having a first end coupled to the first input terminal of the comparator and the output terminal of the duration writing sub-circuit.

7. A display apparatus, comprising a to-be-driven element and the pixel driving circuit of claim 6, wherein the pixel driving circuit is coupled with the to-be-driven element, and the to-be-driven element is a current-driven light emitting diode.

8. The pixel driving circuit of claim 1, wherein the driving sub-circuit comprises a driving transistor having a gate electrode coupled to a second electrode of a duration control transistor of the duration control sub-circuit, a first electrode coupled to the data writing sub-circuit, and a second electrode coupled to the to-be-driven element.

9. A display apparatus, comprising a to-be-driven element and the pixel driving circuit of claim 8, wherein the pixel driving circuit is coupled with the to-be-driven element, and the to-be-driven element is a current-driven light emitting diode.

10. The pixel driving circuit of claim 1, wherein the data writing sub-circuit comprises a data writing transistor having a first electrode electrically coupled to a data line to receive a data signal input from the data line, a second electrode electrically coupled to the driving sub-circuit, and a gate electrode electrically coupled to the data writing control signal line to receive a data writing control signal provided through the data writing control signal line.

11. The pixel driving circuit of claim 1, wherein the pixel driving circuit further comprises at least one of:

a reset sub-circuit coupled to the driving sub-circuit and the to-be-driven element, respectively, and configured to reset the driving sub-circuit and the to-be-driven element;

a compensation sub-circuit coupled to the data writing sub-circuit through the driving sub-circuit and configured to store the data signal input from the data writing sub-circuit; and an operation control sub-circuit coupled to the driving sub-circuit and configured to control the driving sub-circuit to drive the to-be-driven element to emit light.

12. A display apparatus, comprising a to-be-driven element and the pixel driving circuit of claim 1, wherein the pixel driving circuit is coupled with the to-be-driven element, and the to-be-driven element is a current-driven light emitting diode.

13. The display apparatus of claim 12, wherein the display apparatus comprises a plurality of sub-pixels, the pixel driving circuit comprises a plurality of pixel driving circuits, and each of the plurality of sub-pixels is provided with one of the pixel driving circuits for driving the to-be-driven element in the sub-pixel to emit light.

14. The display apparatus of claim 13, further comprising:

a plurality of duration signal lines configured to transmit duration signals;

a plurality of data signal lines configured to transmit the data signal; and a plurality of duration control signal lines configured to transmit duration control signals, wherein pixel driving circuits corresponding to sub-pixels in a same row are electrically coupled to a same duration control signal line; and pixel driving circuits corresponding to sub-pixels in a same column are electrically coupled to a same duration signal line and a same data signal line.

15. A method for driving a pixel driving circuit, wherein the pixel driving circuit is the pixel driving circuit of claim 1, and the method comprises:

writing a data signal into the driving sub-circuit;

writing an operation control signal to control the driving sub-circuit to be turned-on to drive the to-be-driven element to emit light according to the data signal; and controlling a turned-on duration of the driving sub-circuit to control a light emitting duration of the to-be-driven element.

16. The method of claim 15, wherein the controlling the turned-on duration of the driving sub-circuit comprises:

writing a duration signal; and comparing the duration signal with a reference voltage signal to generate a comparison signal, so as to control the turned-on duration of the driving sub-circuit.

* * * * *